US011015413B2

(12) United States Patent
Guidry

(10) Patent No.: US 11,015,413 B2
(45) Date of Patent: May 25, 2021

(54) FRACTURING SYSTEM WITH FLUID CONDUIT HAVING COMMUNICATION LINE

(71) Applicant: Cameron International Corporation, Houston, TX (US)

(72) Inventor: Kirk P. Guidry, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 16/176,898

(22) Filed: Oct. 31, 2018

(65) Prior Publication Data

US 2020/0131877 A1 Apr. 30, 2020

(51) Int. Cl.

| | |
|---|---|
| ***E21B 33/068*** | (2006.01) |
| ***E21B 43/26*** | (2006.01) |
| ***F16L 11/22*** | (2006.01) |
| ***F16L 55/00*** | (2006.01) |
| ***F16L 57/00*** | (2006.01) |
| ***F16L 1/20*** | (2006.01) |

(52) U.S. Cl.
CPC ..... *E21B 33/068* (2013.01); *E21B 43/26* (2013.01)

(58) Field of Classification Search
None
See application file for complete search history.

(56) References Cited

U.S. PATENT DOCUMENTS

| | | | |
|---|---|---|---|
| 1,051,046 | A | 1/1913 | Witzenmann |
| 1,329,760 | A | 2/1920 | Fulton |
| 1,615,536 | A | 1/1927 | Del Mar |
| 2,556,544 | A | 6/1951 | Johnson |
| 2,934,095 | A | 4/1960 | Lockhart |
| 3,118,691 | A | 1/1964 | Press |
| 3,233,668 | A | 2/1966 | Hamilton et al. |
| 3,306,637 | A | 2/1967 | Press et al. |
| 3,393,267 | A | 7/1968 | Busse |
| 3,581,775 | A | 6/1971 | Dahl |
| 3,934,902 | A | 1/1976 | McNamee |

(Continued)

FOREIGN PATENT DOCUMENTS

| | | | |
|---|---|---|---|
| CA | 2178856 | A1 | 12/1997 |
| EP | 1101997 | A1 | 5/2001 |

OTHER PUBLICATIONS

Guidry, U.S. Appl. No. 16/154,461, filed Oct. 8, 2018.

(Continued)

*Primary Examiner* — Matthew R Buck
*Assistant Examiner* — Douglas S Wood
(74) *Attorney, Agent, or Firm* — Eubanks PLLC

(57) ABSTRACT

A fracturing fluid delivery system with a fluid conduit having a communication line is provided. In one embodiment, a fracturing system includes a wellhead assembly and a fracturing fluid conduit coupled to the wellhead assembly to enable receipt of fracturing fluid by the wellhead assembly from the fracturing fluid conduit. The fracturing fluid conduit includes a body defining a bore for conveying the fracturing fluid to the wellhead assembly and also includes a communication line. The communication line transmits signals along the body of the fracturing fluid conduit such that the fracturing fluid conduit facilitates transmission of both the fracturing fluid and the signals. Additional systems, devices, and methods are also disclosed.

20 Claims, 6 Drawing Sheets

(56) References Cited

U.S. PATENT DOCUMENTS

| | | | | |
|---|---|---|---|---|
| 3,993,100 | A | 11/1976 | Pollard et al. | |
| 4,355,961 | A | 10/1982 | Riggs | |
| 4,366,864 | A | 1/1983 | Gibson et al. | |
| 4,385,018 | A | 5/1983 | Kutnyak | |
| 4,405,016 | A | 9/1983 | Best | |
| 4,437,691 | A | 3/1984 | Laney | |
| 4,452,312 | A | 6/1984 | Roblin | |
| 4,559,716 | A | 12/1985 | Daughtry et al. | |
| 4,570,673 | A | 2/1986 | Kendrick et al. | |
| 4,603,887 | A | 8/1986 | Mayfield et al. | |
| 4,632,432 | A | 12/1986 | Reneau | |
| 4,749,047 | A | 6/1988 | Taylor | |
| 4,767,136 | A | 8/1988 | Lehmann | |
| 4,805,430 | A | 2/1989 | Schmitz et al. | |
| 4,998,756 | A | 3/1991 | Hart | |
| 5,158,326 | A | 10/1992 | Anderson et al. | |
| 5,195,589 | A | 3/1993 | Mota et al. | |
| 5,244,045 | A | 9/1993 | Mota | |
| 5,524,710 | A | 6/1996 | Shinn | |
| 5,636,691 | A | 6/1997 | Hendrickson et al. | |
| 5,927,344 | A | 7/1999 | Nobileau | |
| 6,003,604 | A | 12/1999 | Wilkins | |
| 6,004,639 | A * | 12/1999 | Quigley | B29C 70/086 428/36.3 |
| 6,006,788 | A | 12/1999 | Jung et al. | |
| 6,102,445 | A | 8/2000 | Thomas | |
| 6,192,941 | B1 | 2/2001 | Mallen-Herrero et al. | |
| 6,234,030 | B1 | 5/2001 | Butler | |
| 6,364,024 | B1 | 4/2002 | Dallas | |
| 6,609,734 | B1 | 8/2003 | Baugh | |
| 6,691,743 | B2 | 2/2004 | Espinasse | |
| 6,899,172 | B2 | 5/2005 | McLeod et al. | |
| 7,481,239 | B2 | 1/2009 | McGuire et al. | |
| 7,621,324 | B2 * | 11/2009 | Atencio | E21B 34/00 166/250.15 |
| 7,934,546 | B2 | 5/2011 | McGuire et al. | |
| 8,100,182 | B2 * | 1/2012 | Smith | E21B 17/017 166/346 |
| 8,241,453 | B2 | 8/2012 | Beteri et al. | |
| 8,398,122 | B2 | 3/2013 | Crompton et al. | |
| 8,528,585 | B2 | 9/2013 | McGuire | |
| 8,770,277 | B2 | 7/2014 | Artherholt | |
| 8,839,867 | B2 | 9/2014 | Conrad | |
| 8,905,056 | B2 | 12/2014 | Kendrick | |
| 8,960,307 | B2 | 2/2015 | Cain et al. | |
| 8,978,763 | B2 | 3/2015 | Guidry | |
| 9,068,450 | B2 | 6/2015 | Guidry | |
| 9,127,545 | B2 | 9/2015 | Kajaria et al. | |
| 9,175,556 | B2 | 11/2015 | Cherewyk et al. | |
| 9,222,345 | B2 | 12/2015 | Conrad | |
| 9,255,469 | B2 | 2/2016 | Conrad | |
| 9,518,430 | B2 | 12/2016 | Guidry | |
| 9,631,469 | B2 | 4/2017 | Guidry et al. | |
| 9,670,745 | B1 | 6/2017 | Johansen et al. | |
| 9,903,190 | B2 | 2/2018 | Conrad et al. | |
| 9,915,132 | B2 | 3/2018 | Conrad | |
| 9,932,800 | B2 | 4/2018 | Guidry | |
| 10,094,195 | B2 | 10/2018 | Guidry | |
| 10,400,538 | B2 | 9/2019 | Roesner | |
| 10,443,763 | B2 * | 10/2019 | Green | F17D 1/08 |
| 10,480,300 | B2 * | 11/2019 | Guidry | E21B 43/26 |
| 2003/0205378 | A1 | 11/2003 | Wellington et al. | |
| 2003/0205385 | A1 | 11/2003 | Duhn et al. | |
| 2004/0251020 | A1 | 12/2004 | Smith | |
| 2006/0207763 | A1 | 9/2006 | Hofman | |
| 2007/0125544 | A1 | 6/2007 | Robinson et al. | |
| 2007/0227722 | A1 | 10/2007 | Atencio | |
| 2008/0083539 | A1 | 4/2008 | Hickie | |
| 2008/0277120 | A1 | 11/2008 | Hickie | |
| 2009/0014184 | A1 | 1/2009 | Voss et al. | |
| 2009/0090515 | A1 | 4/2009 | Chan et al. | |
| 2009/0145597 | A1 | 6/2009 | Cherewyk | |
| 2009/0261575 | A1 | 10/2009 | Bull et al. | |
| 2010/0032031 | A1 | 2/2010 | Neal | |
| 2010/0051261 | A1 | 3/2010 | Koleilat et al. | |
| 2010/0300672 | A1 | 12/2010 | Childress et al. | |
| 2011/0030963 | A1 | 2/2011 | Demong et al. | |
| 2011/0079399 | A1 | 4/2011 | Nguyen et al. | |
| 2011/0108275 | A1 | 5/2011 | Borak et al. | |
| 2011/0114320 | A1 | 5/2011 | Sponchia et al. | |
| 2011/0132596 | A1 | 6/2011 | Yeh et al. | |
| 2011/0259584 | A1 | 10/2011 | Broussard, II | |
| 2012/0152564 | A1 | 6/2012 | Peltier | |
| 2012/0155813 | A1 | 6/2012 | Quigley et al. | |
| 2012/0181015 | A1 | 7/2012 | Kajaria et al. | |
| 2012/0181016 | A1 | 7/2012 | Kajaria et al. | |
| 2012/0181030 | A1 | 7/2012 | Kajaria et al. | |
| 2012/0242081 | A1 | 9/2012 | Keays et al. | |
| 2013/0076026 | A1 | 3/2013 | Guidry | |
| 2014/0007970 | A1 | 1/2014 | Dodds | |
| 2014/0238683 | A1 | 8/2014 | Korach et al. | |
| 2015/0083426 | A1 | 3/2015 | Lesko et al. | |
| 2015/0159458 | A1 | 6/2015 | Tan et al. | |
| 2015/0275629 | A1 | 10/2015 | Hatton | |
| 2015/0345272 | A1 * | 12/2015 | Kajaria | E21B 47/00 166/250.01 |
| 2015/0354313 | A1 | 12/2015 | McClinton et al. | |
| 2016/0186506 | A1 | 6/2016 | Sha et al. | |
| 2016/0363242 | A1 | 12/2016 | De Nora | |
| 2017/0138144 | A1 | 5/2017 | Christopherson et al. | |
| 2017/0175905 | A1 | 6/2017 | Martino et al. | |
| 2017/0314379 | A1 | 11/2017 | Guidry | |
| 2017/0350223 | A1 | 12/2017 | Guidry et al. | |
| 2018/0291718 | A1 | 10/2018 | Conrad et al. | |
| 2018/0298735 | A1 | 10/2018 | Conrad | |
| 2020/0088021 | A1 | 3/2020 | Guidry | |
| 2020/0131889 | A1 | 4/2020 | Robinson et al. | |

OTHER PUBLICATIONS

Texas Oil Tools: Well Intervention Equipment brochure, 2016, National Oilwell Varco, Houston, Texas, United States of America (15 pages).

Hydraulic Latch Assembly, webpage available at https://www.f-e-t.com/products/completions/well-intervention/pressure-control-equipment/hydraulic-latch-assembly on Jan. 19, 2019, Forum Energy Technologies, Houston, Texas, United States of America (4 pages).

Robinson et al., U.S. Appl. No. 16/727,789, filed Dec. 26, 2019.

Guidry et al., U.S. Appl. No. 16/862,390, filed Apr. 29, 2020.

* cited by examiner

FRACTURING SYSTEM WITH FLUID CONDUIT HAVING COMMUNICATION LINE

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

Additionally, such wellhead assemblies may use a fracturing tree and other components to facilitate a fracturing process and enhance production from a well. As will be appreciated, resources such as oil and natural gas are generally extracted from fissures or other cavities formed in various subterranean rock formations or strata. To facilitate extraction of such resources, a well may be subjected to a fracturing process that creates one or more man-made fractures in a rock formation. This facilitates, for example, coupling of pre-existing fissures and cavities, allowing oil, gas, or the like to flow into the wellbore. Such fracturing processes typically include injecting a fracturing fluid—which is often a mixture including sand and water—into the well to increase the well's pressure and form the man-made fractures. A fracturing manifold may provide fracturing fluid to one or more fracturing trees via fracturing lines (e.g., pipes).

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

At least some embodiments of the present disclosure generally relate to fracturing fluid delivery systems having fluid conduits with communication lines for routing both fluid and signals via the fluid conduits. In certain embodiments, a fracturing manifold is connected to a fracturing tree of a wellhead assembly with a fluid conduit having a communication line. The communication line may include a fiber optic line or an electrical line. Various signals may be routed through a communication line of the fluid conduit, such as data signals or command signals. The communication line can be attached to the exterior of a flexible hose or rigid pipe of the fluid conduit or embedded within the body of the flexible hose or rigid pipe.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
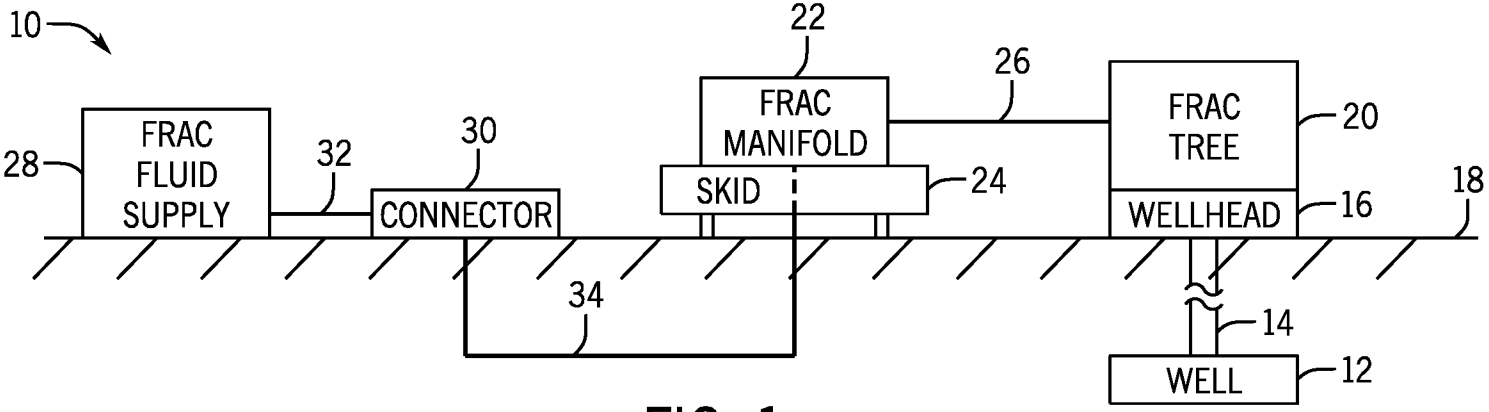
FIG. 1 generally depicts a fracturing system in accordance with an embodiment of the present disclosure.
Figure 2:
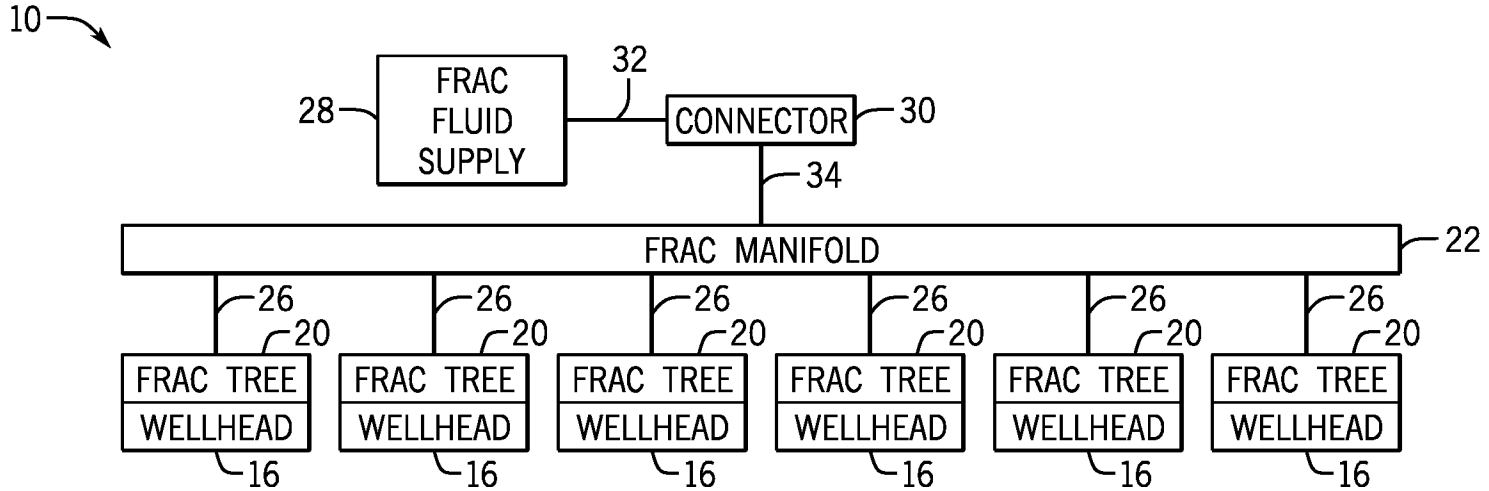
FIG. 2 is a diagram of the fracturing system of FIG. 1 with a fracturing manifold coupled to multiple fracturing trees in accordance with one embodiment.

Turning now to the present figures, an example of a fracturing system 10 is provided in FIGS. 1 and 2 in accordance with one embodiment. The fracturing system 10 facilitates extraction of natural resources, such as oil or natural gas, from a well 12 via a wellbore 14 and a wellhead 16. Particularly, by injecting a fracturing fluid into the well 12, the fracturing system 10 increases the number or size of fractures in a rock formation or strata to enhance recovery of natural resources present in the formation. In the presently illustrated embodiment, the well 12 is a surface well accessed by equipment of wellhead 16 installed at surface level (i.e., on ground 18). But it will be appreciated that natural resources may be extracted from other wells, such as platform or subsea wells.

The fracturing system 10 includes various components to control flow of a fracturing fluid into the well 12. For instance, the depicted fracturing system 10 includes a fracturing tree 20 and a fracturing manifold 22. The fracturing tree 20 includes at least one valve that controls flow of the fracturing fluid into the wellhead 16 and, subsequently, into the well 12. Similarly, the fracturing manifold 22 includes at least one valve that controls flow of the fracturing fluid to the fracturing tree 20 by a conduit or fluid connection 26, such as one or more pipes.

The fracturing manifold 22 is mounted on at least one skid 24 (e.g., a platform mounted on rails) to facilitate movement of the fracturing manifold 22 with respect to the ground 18. As depicted in FIG. 2, the fracturing manifold 22 is connected to provide fracturing fluid to multiple fracturing trees 20 and wellheads 16. But it is noted that the fracturing manifold 22 may instead be coupled to a single fracturing tree 20 in full accordance with the present techniques. In one embodiment in which the fracturing manifold 22 is coupled to multiple fracturing trees 20, various valves of the fracturing manifold 22 may be mounted on separate skids 24 to enable variation in the spacing between the valves.

Fracturing fluid from a supply 28 is provided to the fracturing manifold 22. In FIG. 1, a connector 30 receives fracturing fluid from the supply 28 through a conduit or fluid connection 32, such as pipes or hoses, and then transmits the fluid to the fracturing manifold 22 by way of a subterranean conduit or fluid connection 34. The fracturing fluid could be routed from the supply 28 to the fracturing manifold 22 entirely above ground without use of a subterranean conduit 34 in other instances. In one embodiment, the fracturing fluid supply 28 is provided by one or more trucks that deliver the fracturing fluid, connect to the connector 30, and pump the fluid into the fracturing manifold 22 via the connector 30 and connections 32 and 34. In another embodiment, the fracturing fluid supply 28 is in the form of a reservoir from which fluid may be pumped into the fracturing manifold 22. But any other suitable sources of fracturing fluid and manners for transmitting such fluid to the fracturing manifold may instead be used.

Figure 3:
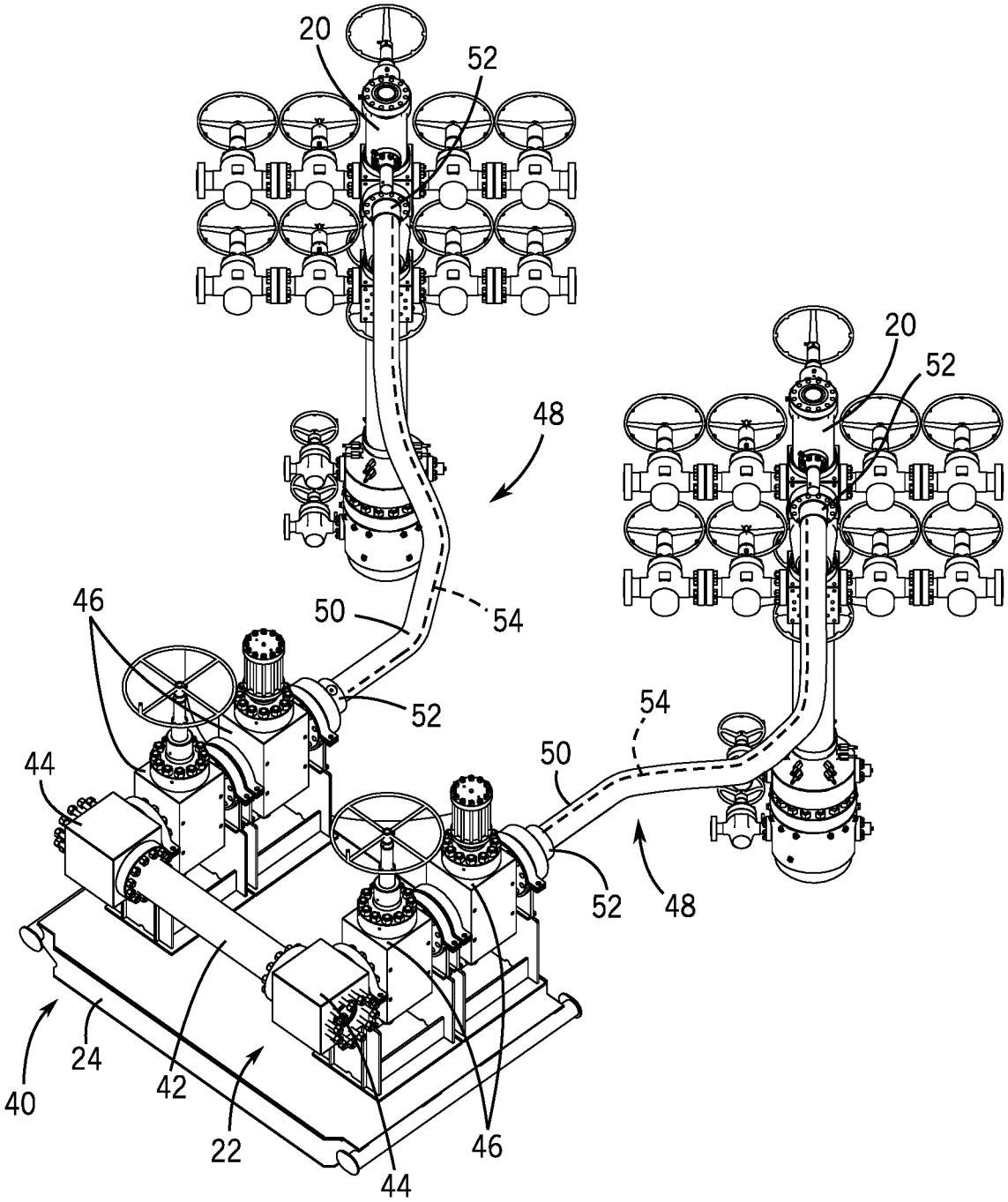
FIG. 3 is a perspective view of certain components of a fracturing system, including a portion of the fracturing manifold mounted on a skid and joined to fracturing trees with fluid conduits having communication lines, in accordance with one embodiment.

In at least some embodiments, fracturing fluid is routed to wellhead assemblies through fluid connections 26 having flexible hoses. One such example is generally depicted in FIG. 3 as having a skid-mounted assembly 40 of the fracturing manifold 22 coupled to a pair of fracturing trees 20 by fluid conduits 48. The assembly 40 includes a pipe 42 spanning connection blocks 44. The pipe 42 and the connection blocks 44 are part of a trunk line of the manifold 22 for routing fracturing fluid to be delivered to multiple fracturing trees, and it will be appreciated that other pipes or conduits can be coupled to the connection blocks 44 to join other portions of the trunk line (e.g., to other skid-mounted assemblies 40, which can be coupled to additional fracturing trees 20).

Valves 46 enable individual control of the flow of fracturing fluid from the trunk line to each fracturing tree 20 through the fluid conduits 48. The valves 46 are depicted here as mounted on the skid 24 as part of the assembly 40 of the fracturing manifold 22. In other instances, valves 46 could be positioned elsewhere (e.g., at the other end of the fluid conduits 48) or omitted (in which case valves of the fracturing trees could be used to control flow of fracturing fluid from the manifold into the wells).

The fluid conduits 48 are each depicted in FIG. 3 as including a flexible hose 50 (which may also be referred to as a flexible pipe) coupled to route fracturing fluid from the manifold 22 to a fracturing tree 20 of a wellhead assembly. The fluid conduits 48 could be connected between the manifold 22 and wellhead assemblies in various manners, but the fluid conduits 48 depicted in FIG. 3 include rigid pipe connectors 52 provided at the ends of the flexible hoses 50 to facilitate installation. The fluid conduits 48 are also shown in FIG. 3 as having communication lines 54 that allow signals to be transmitted along the bodies of the fluid conduits 48.

Figure 4:
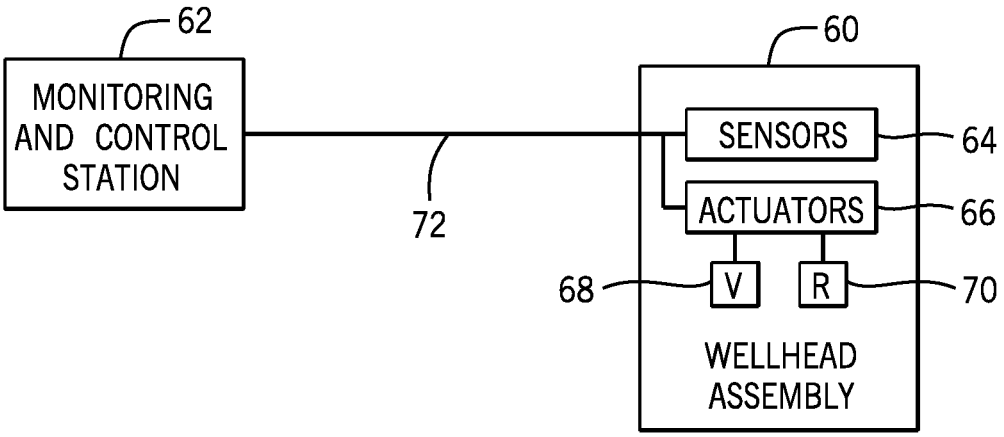
FIG. 4 is a block diagram representing communication with elements of a wellhead assembly in accordance with one embodiment.

The communication lines 54 of the fluid conduits 48 can be used to transmit various signals, such as measurement data or control signals. For example, as generally depicted in FIG. 4, a system can include a wellhead assembly 60 and a monitoring and control station 62 for receiving signals from the wellhead assembly 60 and controlling operation of the system. In at least some embodiments, the wellhead assembly 60 includes a wellhead 16 and a fracturing tree 20 as discussed above. The wellhead assembly 60 could also or instead include other equipment, such as another tree, a blowout preventer, or other flow control devices.

The wellhead assembly 60 of FIG. 4 includes one or more sensors 64 and one or more actuators 66. In various embodiments, a sensor 64 of the wellhead assembly 60 could be a temperature sensor, a pressure sensor, a density sensor, a position sensor, an optical sensor, or a flow rate meter, to name but several examples. Such sensors 64 can be installed at suitable locations in the wellhead assembly 60, such as at the fracturing tree 20, at the wellhead 16, or at other components of the assembly. An actuator 66 of the wellhead assembly 60 can be used to control operation of another device of the wellhead assembly 60, such as a valve 68 (e.g., a valve of a fracturing tree 20) or a ram 70 (e.g., a blowout preventer ram). The actuator 66 can take any suitable form, such as a hydraulic actuator, a pneumatic actuator, or an electric actuator.

In FIG. 4, the wellhead assembly 60 is shown to be communicatively coupled to the monitoring and control station 62 via a communications pathway 72. This communications pathway 72 can be used to communicate data to or from the wellhead assembly 60. In some embodiments, for instance, data acquired with a sensor 64 of the wellhead assembly 60 can be communicated from the wellhead assembly 60 to processing equipment (e.g., of the monitoring and control station 62) via the communications pathway 72. Command signals can also or instead be routed through the communications pathway 72 to the wellhead assembly 60 to control operation of the system, such as by controlling opening or closing of a valve 68 (e.g., of a fracturing tree 20) or ram 70 via an actuator 66.

The monitoring and control station 62 can take any suitable form, such as a computer with a processor that executes instructions stored in a memory device to process received data (e.g., data from the one or more sensors 64) and to control operation of the system. In some embodiments, the monitoring and control station 62 is programmed to control operation of the system based at least in part on measurements received from one or more sensors 64. For instance, in one embodiment the monitoring and control station 62 could issue a command signal to close a valve (such as valve 46 or 68) in response to a measured temperature or pressure above a desired threshold. The monitoring and control station 62 may also be provided as a distributed system with elements provided at different places near or remote from a wellhead assembly 60.

In some embodiments, the communication line 54 of the fluid conduit 48 is used as at least part of the communications pathway 72. That is, the communication line 54 is used to transmit signals between the wellhead assembly 60 and the monitoring and control station 62 or other equipment apart from the wellhead assembly 60. While the communication line 54 may be provided on the exterior of a fluid-conveying pipe or hose of the fluid conduit 48, in at least some embodiments the communication line 54 instead extends through the body of such a pipe or hose.

Figure 5:
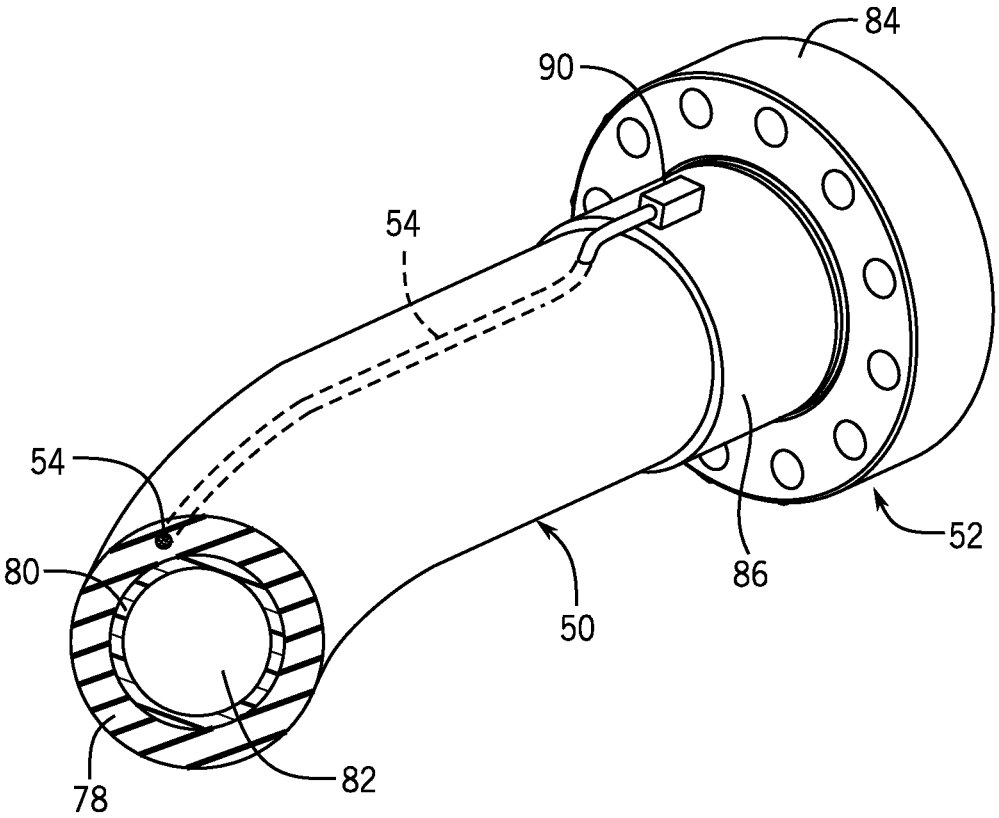
FIG. 5 is a section view of a portion of a fluid conduit of FIG. 3 including a flexible hose having an embedded communication line to allow the fluid conduit to transmit fracturing fluid and signals in accordance with one embodiment.

By way of example, the communication line 54 may be embedded within the flexible hose 50, such as shown in FIG. 5. As depicted, the flexible hose 50 includes a flexible body 78, which may be formed of a polymeric material (e.g., natural or synthetic rubber), a composite material (which may include a polymer), or some other suitable material. In at least some instances, the flexible body 78 is formed with polyetheretherketone (PEEK) or another polymer in the polyaryletherketone (PAEK) family. The inclusion of polymeric or composite materials in the flexible body 78 may reduce the weight of the conduit 48, as compared to a conduit formed entirely of iron or steel. Further, the flexibility provided by such materials allows the conduit 48 to be bent to allow an operator to more easily install the conduit 48 (such as between the fracturing manifold 22 and a fracturing tree 20) by allowing the profile of the conduit 48 to be changed to accommodate differences in spacing, elevation, and angular alignment between connection points for the ends of the conduit 48.

Fracturing fluid typically contains sand or other abrasive particulates that can erode conduits through which the fracturing fluid flows. In at least some embodiments, the hose 50 includes an inner liner 80 within the body 78 along its bore 82 to reduce erosive effects from flow of fracturing fluid or other abrasive fluids through the hose 50. This inner liner 80 may be provided as a rubber layer provided on the interior surface of the body 78 defining the bore 82 but could take various other forms, such as a layer of some other polymeric or composite material. Further embodiments may include a wire mesh liner or a corrugated sleeve liner, such as those described in U.S. Patent Application Publication No. 2017/0314379 (published on Nov. 2, 2017, with the title "Fracturing System with Flexible Conduit"), which is incorporated herein by reference.

During fluid flow through the hose 50, the liner 80 reduces impingement of abrasive particulates on the inner surface of the body 78 and, consequently, reduces erosive wear of the body 78. The liner 80, however, may itself erode in the presence of abrasive flow. Accordingly, in some embodiments the liner 80 is a removable liner. In other instances, the liner 80 could be patched or otherwise repaired. In at least some embodiments, a polymeric or composite inner liner 80 has a different color than a polymeric or composite material of the body 78 such that, when a portion of the inner liner 80 is worn through to the body 78, exposed portions of the inner surface of the body 78 may be more readily observed during inspection due to the contrasting colors. For example, the inner liner 80 may be formed of a black polymeric or composite material and the body 78 may be formed of a contrasting color, such as red, orange, or yellow. Although the hose 50 is depicted with a liner 80 in FIG. 5, it will be appreciated that the hose 50 could be used without a liner in other embodiments.

As noted above, the conduit 48 can include rigid pipe connectors 52 on the ends of the hose 50 to facilitate installation. These rigid pipe connectors 52 can take any suitable form, but in the example depicted in FIG. 5 the pipe connector 52 includes a flange 84 and a neck 86. The flange 84 includes mounting holes for receiving bolts or studs to facilitate connection to a mating component, such as at a fluid port of the fracturing tree 20 or the fracturing manifold 22. In at least some embodiments, the flange 84 is an American Petroleum Institute (API) flange. The neck 86 extends axially from the flange 84 and receives an end of the hose 50. The pipe connector 52 can be made of steel or some other suitable material. And while FIG. 5 depicts just one end of the hose 50 with a rigid pipe connector 52, it will be appreciated that the opposite end of the hose 50 may also include a similar rigid pipe connector 52.

In at least some embodiments, the communication line 54 includes a fiber optic line or an electrical line for carrying signals. More specifically, the communication line 54 can include a fiber optic cable with one or more optical fibers for transmitting light to enable fiber-optic communication via the fluid conduit 48. In other instances, the communication line 54 includes an electrical cable with one or more conductive wires for carrying electric current. The communication line 54 (or elements thereof, such as the optical fibers or conductive wires) can be enclosed within one or more insulating or other protective layers, such as insulation, cladding, coatings, or other protective covers.

Communication signals (e.g., optical or electrical signals) can be conveyed along the fluid conduit 48 via the communication line 54. As noted above, such signals can include data communication to or from the wellhead assembly 60 (such as data acquired with a sensor 64) and command signals to the wellhead assembly 60 to control operation (such as by controlling an actuator 66). And as discussed in greater detail below, the communication line 54 could also or instead carry signals indicating erosive or other wear of the fluid conduit 48. Further, in at least one embodiment, the communication line 54 could be used to transmit electrical power for operating one or more components of the wellhead assembly 60 (e.g., a sensor 64 or actuator 66).

As depicted in FIG. 5, the communication line 54 is attached to a signal connector 90 to facilitate communication with other equipment, such as the sensors 64, the actuators 66, or the monitoring and control station 62. Additional communication lines may be connected between various devices and the connector 90 to allow communication between the various devices and the communication line 54 of the fluid conduit 48 via the connector 90. In addition to routing signals to and from the communication line 54, the connector 90 may include circuitry for conditioning communication signals. Further, in some instances the connector 90 includes at least one converter to facilitate communication, such as a digital-to-analog converter, an analog-to-digital converter, an optical-to-electrical converter, or an electrical-to-optical converter. In one embodiment, for example, the communication line 54 could be a fiber optic line for communicating optical signals and the connectors 90 at the ends of the communication line 54 can include converters for converting between electrical and optical signals.

The fluid conduit 48 can include the signal connector 90, which can be mounted on the neck 86 or on some other suitable portion of the fluid conduit 48. By way of example, in FIG. 5 the communication line 54 is embedded in the body 78 of the hose 50 and extends radially outward (i.e., away from the flow axis of the bore 82) from a side of the body 78 to facilitate connection with the signal connector 90. In other embodiments, the signal connector 90 could be mounted elsewhere (e.g., on the fracturing tree 20 or the fracturing manifold 22) or remain unmounted while being connected to the hose 50 via the communication line 54.

Figure 6:
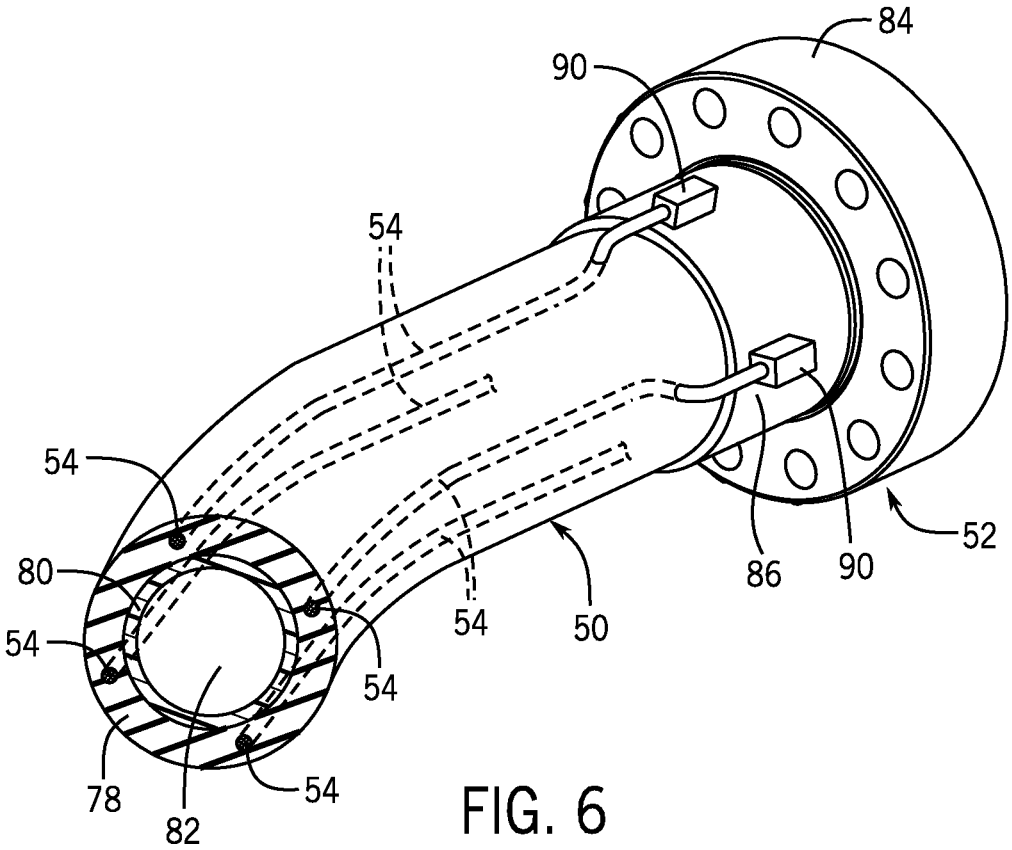
FIG. 6 is a section view of a portion of a fluid conduit having multiple embedded communication lines for routing signals in accordance with one embodiment.

Although a single communication line 54 is depicted in FIG. 5, the fluid conduit 48 could include multiple communication lines 54. As shown in FIG. 6, for instance, the fluid conduit 48 includes four communication lines 54, but in other embodiments the fluid conduit 48 could include some other number of communication lines 54. The communication lines 54 could each connect to an individual signal connector 90 (i.e., each of the four communication lines 54 could be connected to its own signal connector 90), or some or all of the multiple communication lines 54 could be connected to a shared signal connector 90.

While a communication line 54 can be used to communicate commands, data, or other information between the wellhead assembly 60 and other equipment via the fluid conduit 48, in some embodiments the communication line 54 is also or instead used to sense wear of the fluid conduit 48, such as erosive wear within the hose 50. In some cases, for example, the communication line 54 can be used to sense gas or another fluid indicative of erosive wear of the interior surface of the body 78 or the inner liner 80. More specifically, as erosion wears the interior of the hose 50, a communication line 54 embedded in the hose 50 may be exposed to fluid within the bore 82. The communication line 54 may be monitored in any suitable manner to detect such exposure or other wear, such as by detecting a change in temperature, a change in a transmission property of the communication line 54, or a loss of continuity. In one embodiment, for instance, the communication line 54 is a fiber optic line and distributed temperature sensing may be used to detect temperature variation along the length of the communication line 54, or changes in temperature at a given position along the communication line 54, indicative of wear.

The location of a communication line 54 embedded in the hose 50 may vary between embodiments. In FIGS. 5 and 6, the communication lines 54 are embedded in the body 78 radially outward of the inner liner 80 and generally extend longitudinally along the length of the hose 50. In some cases, one or more communication lines 54 can be provided in contact with a surface of the inner liner 80 or can be embedded within the inner liner 80.

Figure 7:
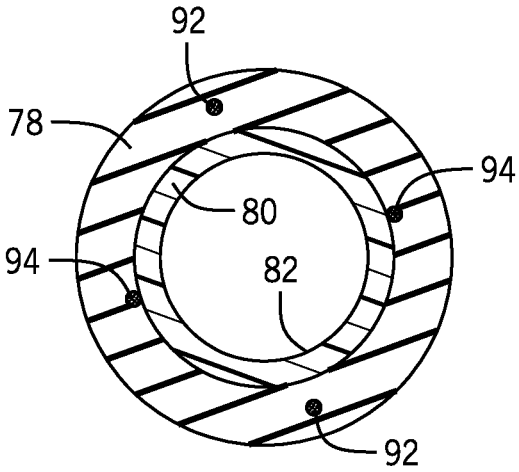
FIGS. 7 and 8 show arrangements of various communication lines within a flexible hose in accordance with two embodiments.
Figure 8:
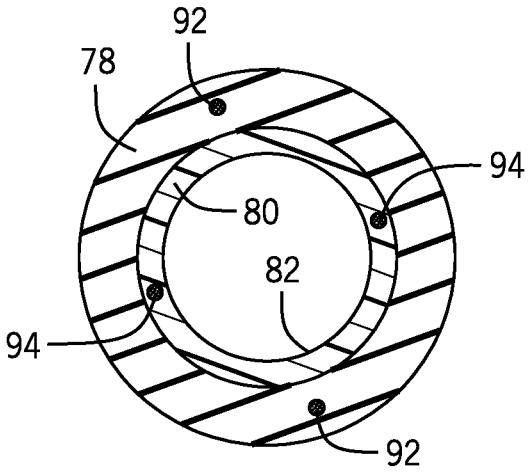

In FIG. 7, for example, the hose 50 includes a first pair 92 of communication lines 54 embedded in the body 78 apart from the inner liner 80, and a second pair 94 of communication lines 54 provided in contact with the outer surface of the inner liner 80 (i.e., the surface abutting the body 78). Each of these communication lines could be used for communicating with the wellhead assembly 60 or detecting erosion within the hose 50. But placement of the second pair 94 of communication lines 54 closer to the bore 82 (e.g., in contact with the outer surface of the inner liner 80) may facilitate erosion detection, while the placement of the first pair 92 of communication lines 54 further from the bore 82 may reduce the likelihood of erosion within the hose 50 negatively impacting communications to or from the wellhead assembly 60 via the first pair 92 of communication lines. As such, in at least some instances, the first pair 92 of communication lines 54 could be used for signal communication to or from the wellhead assembly 60, while the second pair 94 of communication lines 54 could be used for erosion detection. In FIG. 8, the second pair 94 of communication lines 54 are embedded within the inner layer 80, which may allow an even earlier indication of erosion within the hose 50.

Figure 9:
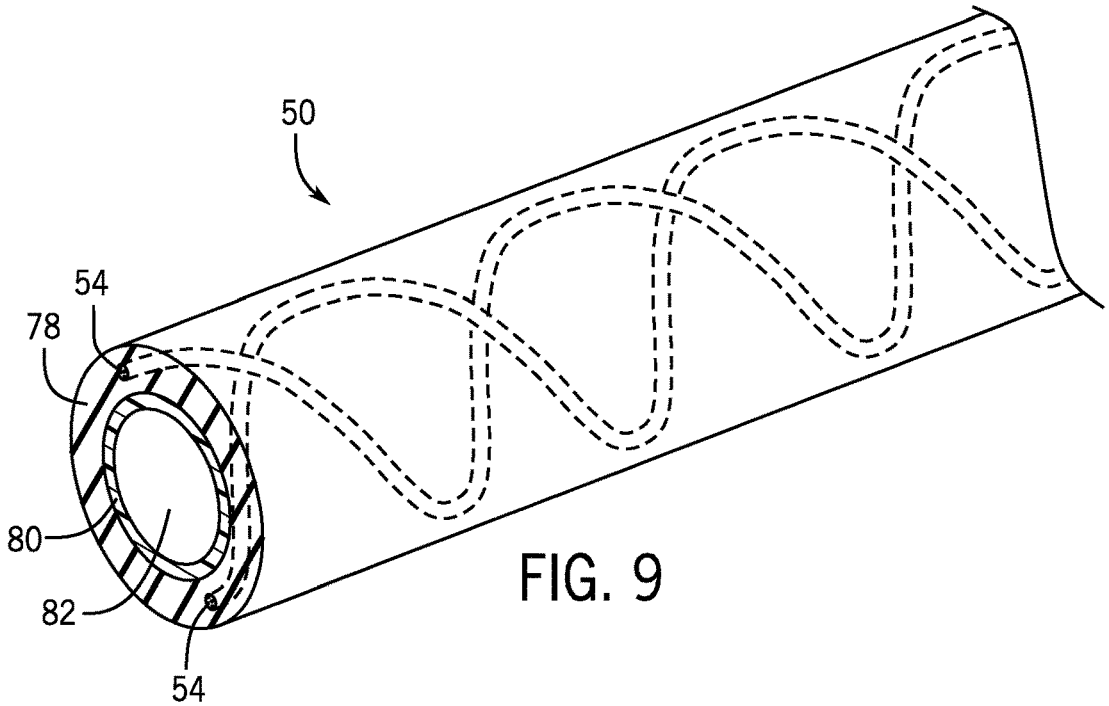
FIG. 9 depicts communication lines extending helically through a portion of a flexible hose in accordance with one embodiment.

Although FIGS. 6-8 depict hoses 50 with four communication lines 54, it is again noted that the hose 50 could have a different number of communication lines 54 in other embodiments. The hose 50 could include, for example, a greater number of communication lines (such as four to eighteen lines) that are within or in contact with the inner liner 80 so as to facilitate improved erosion detection. And while the communication lines 54 may extend along the hose 50 in a generally longitudinal direction, such as shown in FIGS. 5 and 6, the communication lines 54 may extend through the hose 50 in other manners. In one embodiment depicted in FIG. 9, for instance, the hose 50 includes two communication lines 54 extending helically through the body 78.

Figure 10:
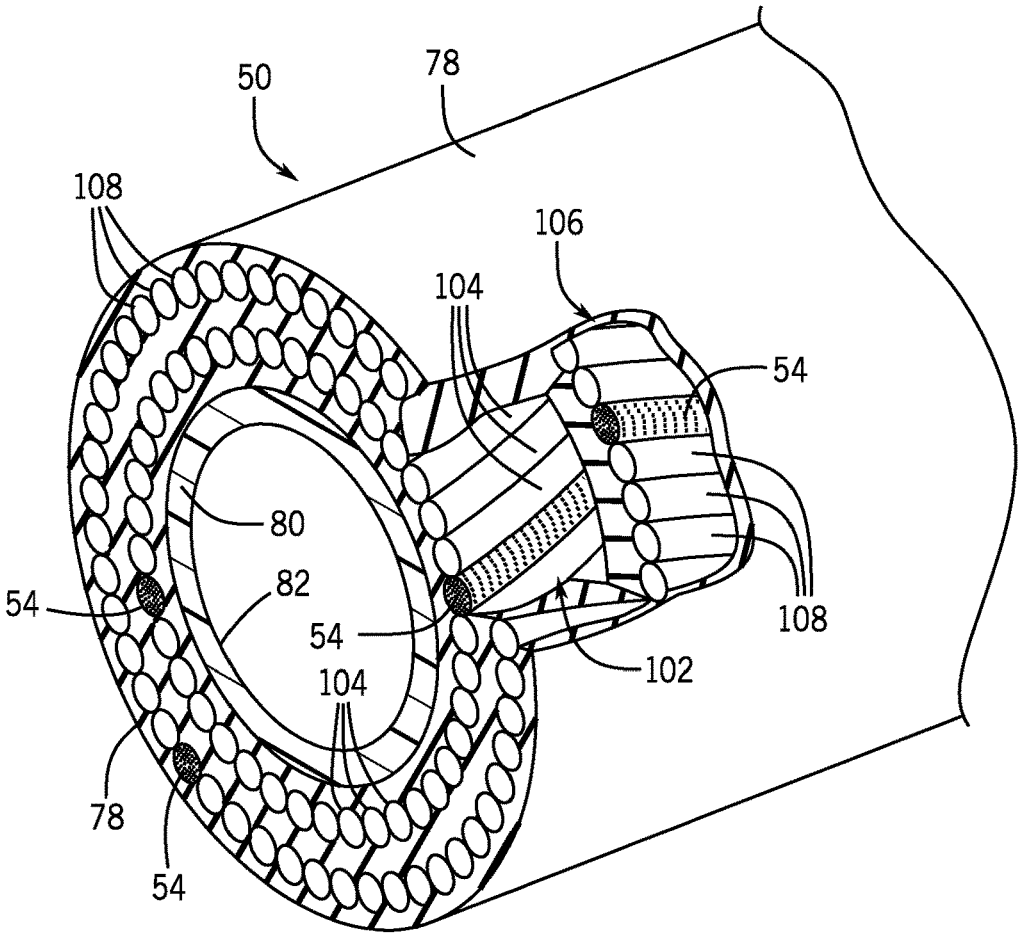
FIG. 10 is a section view of a wire-belted flexible hose having communication lines in accordance with one embodiment.

In certain embodiments, the fluid conduit 48 includes a reinforced hose 50. One example of such a reinforced hose 50 is generally depicted in FIG. 10 as having a wire-belted flexible body 78. More specifically, the hose 50 of FIG. 10 includes an inner wire belt 102 with wires 104 and an outer wire belt 106 with wires 108, which are embedded in the flexible hose body 78, such as in a polymeric or composite material. Although FIG. 10 depicts two wire belts (which may also be referred to as plies or wraps), other embodiments of a wire-belted hose could include a single wire belt or more than two wire belts. The wires 104 and 108 are depicted in FIG. 10 as extending helically in opposite directions (i.e., clockwise and counterclockwise) through the hose 50, but these wires (which may also be referred to as cords) could be arranged differently in other embodiments. In at least one embodiment, the belts 102 and 106 include wires 104 and 108 made of steel, such that the hose 50 is a steel-belted hose. The wires 104 and 108, however, can be made with some other material, such as another metal, a natural fiber (e.g., cotton or silk), a synthetic fiber (e.g., nylon or Kevlar), or a composite.

In some embodiments having a reinforced hose 50, one or more communication lines 54 are incorporated into a layer of reinforcing material. In FIG. 10, for example, two communication lines 54 are integrated as part of the inner wire belt 102 and two other communication lines 54 are integrated as part of the outer wire belt 106. The inclusion of a communication line 54 in the wire belt 102 or 106 allows the signals to be routed along the hose 50 through that wire belt via the integrated communication line 54. Each of the belts 102 and 106 are depicted in FIG. 10 as including one layer of wires (i.e., one radially inward layer of wires 104 and one radially outward layer of wires 106) for ease of explanation, but it will be appreciated that the belts 102 and 106 may be incorporated into the body 78 of the hose 50 in other manners. In some embodiments, for example, a wire belt (e.g., belt 102 or 106) can be wrapped around the inner liner 80 or another layer of the body 78 during hose manufacture so as to partially overlap other portions of that wire belt and cause at least some wires of the belt to overlap other wires of the belt.

Figure 11:
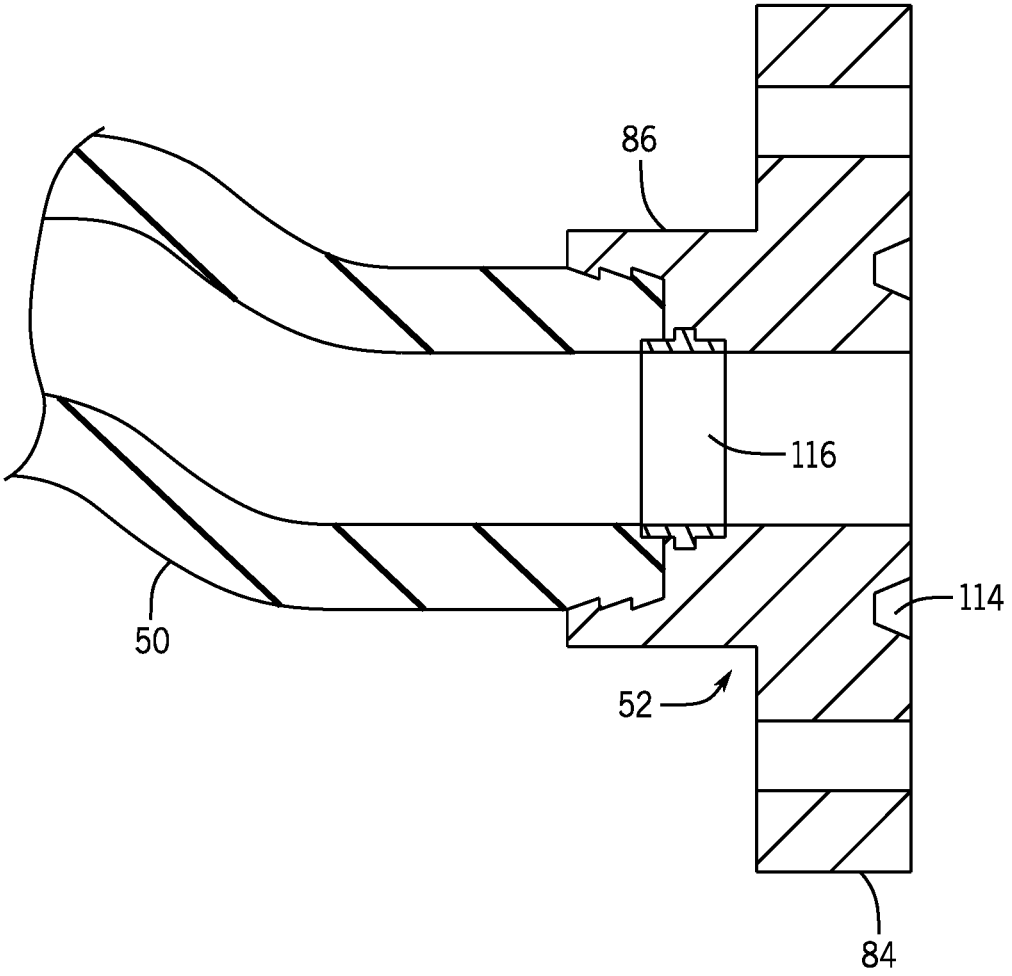
FIG. 11 is a cross-section of an end of a flexible hose attached to a rigid connector in accordance with one embodiment.

The rigid pipe connectors 52 can be attached to the hose 50 in any suitable manner. In one embodiment generally depicted in FIG. 11, an end of the hose 50 is received within the neck 86 of a pipe connector 52. The flange 84 can be used to fasten the connector 52 to other equipment, such as the fracturing tree 20 or the fracturing manifold 22. The connector 52 can also include an annular seal groove 114 for receiving a gasket or other seal to facilitate a fluid-tight connection when the hose 50 is fastened to other equipment. As presently shown, a forged ring 116 is used to help retain the end of the hose 50 within the connector 52. During manufacture, for instance, a ring 116 having a diameter less than that of the bore of connector 52 can be positioned within the connector 52 near the end of the hose 50 and then forged (e.g., by swaging) into the shape and position shown in FIG. 11 so as to overlap the end of the hose 50 and an interior surface of the connector 52. A second connector 52 can be attached to the opposite end of the hose 50 in a similar manner. In other embodiments, however, the hose 50 can be attached to connectors 52 with epoxy or in some other manner without forging. And while certain hoses 50 are described above as including communication lines 54, the connectors 52 could be attached to a hose 50 that does not have a communication line 54.

The conduits 48 and the fracturing fluid delivery systems described above can be constructed for various operating pressures and with different bore sizes depending on the intended application. In some embodiments, the fluid conduits 48 are constructed for rated maximum operating pressures of 10-15 ksi (approximately 69-103 MPa). Further, the conduits 48 of some embodiments have bores between four and eight inches (approx. 10 and 20 cm) in diameter, such as a five-and-one-eighth-inch (approx. 13 cm) diameter or a seven-inch (approx. 18 cm) diameter. Additionally, while certain examples are described above regarding the use of conduits 48 for transmitting fluid and signals to a wellhead assembly, the conduits 48 having communication lines 54 could also be used in other instances to convey fluids and signals between other components.

Further still, while certain examples of fluid conduits 48 are described above as having flexible hoses 50 and communication lines 54, it will be appreciated that the communication lines 54 could also or instead be used with rigid fluid conduits 48. In some embodiments, for instance, communication lines 54 can be positioned along the exterior of rigid pipe segments or can be positioned in holes extending through the bodies of rigid pipe segments of a fluid conduit 48. In one embodiment, a fluid conduit 48 may include a combination of rigid and flexible pipes (such as described in U.S. Patent Application Publication No. 2017/0314379 noted above), with one or more communication lines 54 provided on the exterior of one or more rigid pipes and embedded within the one or more flexible pipes.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A fracturing system comprising:

a wellhead assembly;

a fracturing fluid conduit coupled to the wellhead assembly to enable receipt of fracturing fluid by the wellhead assembly from the fracturing fluid conduit, wherein the fracturing fluid conduit includes a body defining a bore for conveying the fracturing fluid to the wellhead assembly, and the fracturing fluid conduit also includes a communication line configured to transmit signals along the body of the fracturing fluid conduit, such that the fracturing fluid conduit facilitates transmission of both the fracturing fluid and the signals; and a fracturing manifold coupled to a fracturing tree of the wellhead assembly via the fracturing fluid conduit.

2. The fracturing system of claim 1, wherein the body of the fracturing fluid conduit includes a flexible body defining the bore and formed of a polymeric or composite material.

3. The fracturing system of claim 2, wherein the communication line is embedded in the flexible body.

4. The fracturing system of claim 1, wherein the wellhead assembly includes at least one sensor and the communication line is connected to route data acquired with the at least one sensor away from the wellhead assembly via the fracturing fluid conduit.

5. The fracturing system of claim 1, wherein the wellhead assembly includes an actuator and the communication line is connected to route a command signal to the wellhead assembly via the fracturing fluid conduit to control operation of the actuator.

6. The fracturing system of claim 1, wherein the fracturing fluid conduit includes an inner liner within the body along the bore.

7. The fracturing system of claim 6, wherein the communication line is positioned along the body of the fracturing fluid conduit radially outward of the inner liner.

8. The fracturing system of claim 1, wherein the communication line is a fiber optic line.

9. The fracturing system of claim 1, wherein the communication line is an electrical line.

10. The fracturing system of claim 1, wherein the fracturing system is an onshore fracturing system, the wellhead assembly is a surface wellhead assembly, and the fracturing fluid conduit is coupled to the surface wellhead assembly to provide the fracturing fluid to a surface well through the surface wellhead assembly.

11. An apparatus comprising:

a fracturing fluid hose including:

a flexible hose body having a bore for conveying fracturing fluid; and a communication line to route signals along the flexible hose body; and a fracturing manifold coupled to a fracturing tree of a wellhead assembly via the fracturing fluid hose.

12. The apparatus of claim 11, comprising a signal connector coupled to the communication line to facilitate communication between the communication line and other equipment.

13. The apparatus of claim 12, wherein the communication line is embedded in the flexible hose body and extends out a side of the flexible hose body to facilitate connection with the signal connector.

14. The apparatus of claim 12, wherein the fracturing fluid hose includes the signal connector.

15. The apparatus of claim 11, wherein the fracturing fluid hose includes a rigid pipe connector coupled to the flexible hose body.

16. A method comprising:

coupling a fracturing manifold to a fracturing tree of a wellhead assembly via a fracturing fluid hose, wherein the fracturing fluid hose includes a flexible body having an internal bore;

routing fracturing fluid toward the wellhead assembly through the internal bore of the fracturing fluid hose; and routing signals along the fracturing fluid hose through a communication line embedded within the flexible body of the fracturing fluid hose.

17. The method of claim 16, wherein the wellhead assembly includes a sensor and routing signals along the fracturing fluid hose through the communication line embedded within the flexible body of the fracturing fluid hose includes routing data acquired with the sensor away from the wellhead assembly through the communication line embedded within the flexible body of the fracturing fluid hose.

18. The method of claim 16, wherein the wellhead assembly includes an actuator and routing signals along the fracturing fluid hose through the communication line embedded within the flexible body of the fracturing fluid hose includes routing a command signal for controlling operation of the actuator to the wellhead assembly through the communication line embedded within the flexible body of the fracturing fluid hose.

19. The method of claim 16, comprising detecting erosion of the flexible body along the internal bore via the communication line.

20. The method of claim 16, wherein the flexible body of the fracturing fluid hose is a wire-belted body, the communication line is integrated as part of a wire belt within the wire-belted body, and routing signals along the fracturing fluid hose through the communication line embedded within the flexible body of the fracturing fluid hose includes routing signals along the fracturing fluid hose through the wire belt via the communication line.

* * * * *